US005889244A

United States Patent [19]

Kraus

[11] Patent Number: 5,889,244

[45] Date of Patent: Mar. 30, 1999

[54] DISHWASHER SEQUENCE SWITCH UNIT

[75] Inventor: Frederick Lee Kraus, Louisville, Ky.

[73] Assignee: General Electric Company, Louisville, Ky.

[21] Appl. No.: 826,849

[22] Filed: Apr. 10, 1997

[51] Int. Cl.[6] ..... H01H 43/00

[52] U.S. Cl. ..... 200/38 R; 200/38 B

[58] Field of Search ..... 200/33 R, 35 R, 200/36, 37 R, 37 A, 38 R, 38 A, 38 F, 38 FA, 38 FB, 38 B, 38 BA, 38 CA, 38 D, 38 DA, 38 DB, 38 DC; 340/309.15

[56] References Cited

U.S. PATENT DOCUMENTS

| | | | |
|---|---|---|---|
| 3,118,982 | 1/1964 | Pulley | 200/38 |
| 3,540,029 | 11/1970 | Bassett | 340/309.1 |
| 3,591,737 | 7/1971 | Marble et al. | 200/35 |
| 3,626,117 | 12/1971 | Stafford | 200/38 F |
| 4,060,702 | 11/1977 | Linn | 200/35 R |
| 4,123,628 | 10/1978 | Kern et al. | 200/38 FB |
| 4,283,607 | 8/1981 | Brightman | 200/38 R |
| 4,355,217 | 10/1982 | Cushing | 200/38 R |
| 4,362,953 | 12/1982 | Bolin | 307/141 |
| 4,370,566 | 1/1983 | Perry et al. | 307/141 |
| 4,468,600 | 8/1984 | Barthel et al. | 318/452 |
| 4,497,985 | 2/1985 | Courter et al. | 200/38 R |
| 4,497,986 | 2/1985 | Zink et al. | 200/38 R |
| 4,525,608 | 6/1985 | Cushing | 200/38 R |
| 4,531,028 | 7/1985 | Stout et al. | 200/38 R |
| 4,560,846 | 12/1985 | Klopp et al. | 200/38 R |
| 4,577,179 | 3/1986 | Chambers et al. | 340/309.15 |
| 4,626,635 | 12/1986 | Mahon | 200/38 A |
| 4,677,260 | 6/1987 | Nagasaki et al. | 200/6 BB |
| 4,743,820 | 5/1988 | Veach | 318/578 |
| 4,755,635 | 7/1988 | Willigman | 200/35 R |
| 4,892,983 | 1/1990 | Bogda et al. | 200/38 R |
| 4,983,790 | 1/1991 | Bogda et al. | 200/30 R |
| 5,150,489 | 9/1992 | Kaji et al. | 8/159 |
| 5,211,037 | 5/1993 | Adamski et al. | 68/12.16 |

*Primary Examiner*—Michael A. Friedhofer
*Attorney, Agent, or Firm*—H. Neil Houser

[57] ABSTRACT

A sequence switch unit for use in a dishwasher eliminates a need for a separate timer and relay for each dishwasher component during the washing portion of the cycle. In one embodiment, the sequence switch unit includes a switch disk having a plurality of contact blade tracks, a lower control track, an upper control track, and a ramp connecting the lower control track and the upper control track. The sequence switch unit includes a blade unit including a plurality of contact blade assemblies. Each of the contact blade assemblies has an elongate fixed blade having a fixed contact and an elongate movable blade having a movable contact. The contact blade assemblies are normally in a closed condition. The movable blades are movable so that the contact blade assemblies can be positioned in an open condition. A switch lift lever is secured to and rotatable with the switch disk, and the switch lever extends between the fixed blade and the movable blade of each contact blade assembly. The switch lift lever includes a lever blade and a finger extending from the lever blade. The lever blade extends between the fixed blade and the movable blade of each contact blade assembly. The lever blade finger is oriented to travel within the lower and upper tracks. A drive gear is coupled to the switch disk, and a motor is coupled to the drive gear so that when the motor causes the drive gear to rotate, the switch disk rotates with the drive gear.

20 Claims, 1 Drawing Sheet

DISHWASHER SEQUENCE SWITCH UNIT

FIELD OF THE INVENTION

This invention relates generally to dishwashers and, more particularly, to a sequence switch unit for controlling the energization of dishwasher components during the wash cycle of a dishwashing operation.

BACKGROUND OF THE INVENTION

Known dishwashers typically include a motor for driving a circulation pump, a drain solenoid for diverting water so that the water accumulated in the dishwasher can be pumped out of the washing chamber, a water valve for controlling the flow of water into the dishwasher, and a heating element for heating the water and drying the dishes. In an exemplary dishwashing cycle, the circulation pump motor is energized, and then the water valve is opened so that water flows into the dishwasher and is circulated by the circulation pump. Once sufficient water has been supplied to the dishwasher, the water valve is closed but the circulation pump motor continues to operate to circulate the supplied water. After a predetermined period of time, the heating element is energized while the circulation pump motor remains energized so that heated water is circulated within the washing chamber. The heating element is then deenergized, and the drive solenoid is energized to open the drain valve while the circulation pump motor remains energized. As a result, water flows out from the dishwasher. The drive solenoid is then deenergized so that the drain valve closes, and the circulation pump motor remains energized. The above described sequence is repeated during the wash portion of the dishwashing cycle. The sequence may be repeated, for example, four to seven times depending on the wash cycle selected.

In an all-electronic control system, the circulation pump motor, drain solenoid, water valve, and heating element typically are controlled by separate timers and relays. For example, a timer for the circulation pump motor supplies a timing signal to the motor relay, and based on the timing signal, the motor relay controls energization and deenergization of the circulation pump motor. Similar controls are provided for each of the drain solenoid, the water valve, and the heating element.

If the separate timers and relays for the above described components could be eliminated, the component cost and assembly time associated with fabrication of known dishwashers could be reduced. In addition, by eliminating such separate components, the maintenance and repair costs associated with known dishwashers also possibly could be reduced. Of course, in reducing the cost of the dishwasher, the operation of the dishwasher should not be adversely affected.

SUMMARY OF THE INVENTION

These and other objects may be attained in a sequence switch unit for a dishwasher which eliminates a need for a separate timer and relay for each dishwasher component during the washing portion of the cycle. More particularly, and in accordance with one embodiment, the sequence switch unit includes a switch disk having a plurality of contact blade tracks, a lower control track, an upper control track, and a ramp connecting the lower control track and the upper control track. The sequence switch unit also includes a blade unit having a plurality of contact blade assemblies. Each contact blade assembly includes an elongate fixed blade having a fixed contact and an elongate movable blade having a movable contact. Each contact blade assembly normally is in a closed condition in which the movable contact is in electric circuit with the fixed contact. The movable blades, however, are movable so that the contact blade assemblies can be positioned in an open condition in which each movable contact is not in electric circuit with its respective fixed contact.

A switch lift lever is secured to and rotatable with the switch disk, and the switch lever extends between the fixed blade and the movable blade of each contact blade assembly. More particularly, the switch lift lever includes a lever blade and a finger extending from the lever blade. The lever blade extends between the fixed blade and the movable blade of each contact blade assembly. The lever blade finger is oriented to travel within the lower and upper tracks.

A drive gear is coupled to the switch disk, and a motor is coupled to the drive gear so that when the motor causes the drive gear to rotate, the switch disk rotates with the drive gear. The switch disk is rotatable relative to the switch unit.

Prior to operation, each contact blade assembly is electrically connected to one of the dishwasher components, e.g., the drain solenoid, water valve, and heating element. In operation, and as the switch disk rotates (e.g., counter clockwise) relative to the switch unit, the position of each movable blade relative to its respective fixed blade is controlled by the elevation of track on which the respective blade assembly rides. The track elevations are selected to correspond to the timing sequence desired for each respective component.

At the beginning of a cycle, the lever blade finger is in the lower control track, and the lever blade is in a neutral position. In the neutral position, the lever blade does not affect a state of the contact blade assemblies. At the end of a cycle, however, the lever blade finger drops on the ramp, and the lever blade then rides up the ramp to the upper control track. When the lever blade finger is in the upper control track, the lever blade causes each of the movable blades to move away from its respective fixed blade so that each contact blade assembly is in the open position. The switch disk is then rotated back (e.g., clockwise) to its initial position for the beginning of the cycle, and the lever blade finger drops into the lower track. The cycle can then be repeated.

By opening the contact blade assemblies at the end of the cycle and then returning the switch disk to the initial position, the components coupled to each contact blade assembly are simply deenergized at the end of the cycle until the wash cycle is repeated. If the contact blade assemblies were not maintained open when rotating the disk back to its initial condition, the various components would be energized and deenergized as the disk is rotated back to its initial position. Of course, energizing and deenergizing the various components when returning to the start of the wash cycle would be highly undesirable.

Further, the present sequence switch unit enables the elimination of separate timers and relays for at least some dishwasher components. Therefore, the component cost and assembly time associated with fabrication of known dishwashers is believed to be reduced. In addition, by eliminating such separate components, the maintenance and repair costs associated with known dishwashers also are believed to be reduced.

DETAILED DESCRIPTION OF THE DRAWINGS

Figure 1:
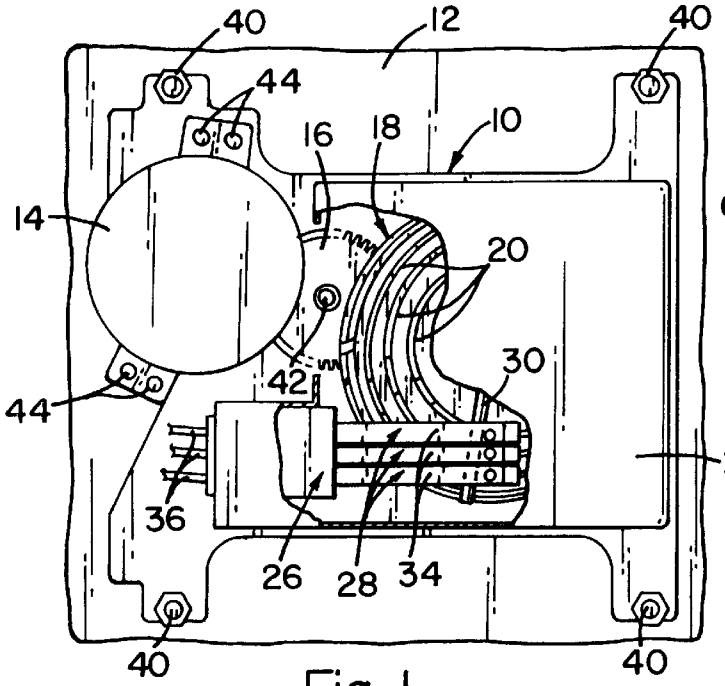
FIG. 1 is a top view, with components cut away, of a dishwasher sequence switch unit in accordance with one embodiment of the present invention.

FIG. 1 is a top view, with components cut away, of a dishwasher sequence switch unit 10 in accordance with one embodiment of the present invention. Unit 10 is shown as being secured to a dishwasher 12 which may, for example, be a dishwasher commercially available from General Electric Company, Appliance park, Louisville, Ky. 40225, modified to include unit 10, which is described below in more detail. Unit 10 can be used in connection with many different dishwashers and is not limited to use with any one particular dishwasher.

As shown in FIG. 1, unit 10 includes an electric motor 14 coupled to a drive gear 16, and a switch disk 18 driven by drive gear 16. Motor 14 is reversible so that motor 14 can cause drive gear 16 to rotate in clockwise and counterclockwise directions. Drive gear 16 is coupled to switch disk 18 so that disk 18 rotates with drive gear 16. Switch disk 18 has a plurality of contact blade tracks 20, a lower control track 22 and an upper control track 24.

Sequence switch unit 10 also includes a blade unit 26 having a plurality of contact blade assemblies 28. A switch lift lever 30 is secured to and rotatable with switch disk 18, and switch lever 30 extends between a fixed blade 32 (not visible in FIG. 1) and a movable blade 34 of each contact blade assembly 28. Switch disk 18 is rotatable relative to blade unit 26. A plurality of leads 36 extend to blade unit 26, and each respective lead 36 is coupled to one of respective blade assemblies 28.

Switch disk 18 and blade unit 26 are located within a plastic housing 38, and drive gear 16 partially extends into housing 38 to mesh with switch disk 18. Housing 38 is secured to dishwasher 12 by bolts 40. Drive gear 16 rotates on a bearing 42 secured to housing 38, and motor 14 is secured to dishwasher 12 by bolts 44.

Generally and in operation, as switch disk 16 rotates counterclockwise, each blade assembly 28 travels on a respective track 20 of switch disk 18. Each track 20 has various control elevations which cause movable blades 34 to move into and out of electrical contact with its fixed blade 32 so as to make and break the electric circuit formed by movable blade 34 and fixed blade 32. When a respective one of blade assemblies 28 is in a closed condition, the component coupled to respective lead 36 electrically connected to such blade assembly 28 is energized. When such blade assembly 28 is in an open condition, the component is deengergized. In this manner, unit 10 controls the energization and deenergization, in a timed sequence, of a plurality of respective components of dishwasher 12.

Of course, at the end of a wash cycle, switch disk 16 must be rotated back (e.g., clockwise) to its initial position. As described below in more detail, lift lever 30 operates to position each blade assembly 28 in an open condition when disk 18 is rotated clockwise so that blade assemblies 28 do not switch close when returning the start of a wash cycle.

Motor 14 may be a fractional horsepower electric motor selected to drive disk 16 at a selected rate depending upon the specific wash cycle to be implemented. Drive gear 16 and switch disk 18 may be fabricated from a plastic. Blade assemblies 28 and switch lift lever 30 may be fabricated from, for example, spring steel. Housing 38 may be molded from a plastic.

Figure 2:
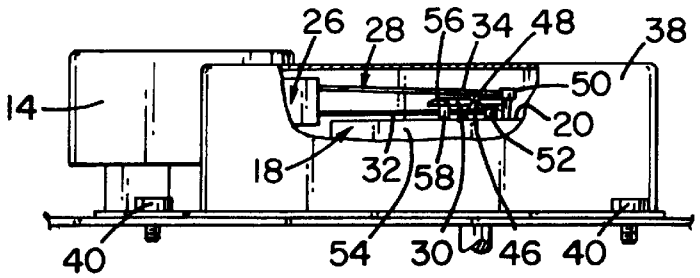
FIG. 2 is a side view, with components cut away, of the sequence switch unit shown in FIG. 1.

FIG. 2 is a side view, with components cut away, of sequence switch unit 10. As shown in FIG. 2, each contact blade assembly 28 includes elongate fixed blade 32 having a fixed contact 46 and elongate movable blade 34 having a movable contact 48. Each contact blade assembly 28 normally is in a closed condition, as shown in FIG. 2, in which movable contact 48 is in electric circuit with fixed contact 46. Movable blades 34, however, are movable so that contact blade assemblies 28 can be positioned in an open condition in which each movable contact 48 is not in electric circuit with its respective fixed contact 46.

More specifically, each movable blade 34 includes a finger 50 which extends into a respective one of tracks 20 of disk 18. Each fixed blade 32 includes an end member 52 which travels on fixed elevation sidewalls 54 on opposing sides of each respective track 20. Although the elevation of each track 20 may vary, the elevation of each sidewall 54 is fixed. Therefore, as the elevation of each respective track 20 changes, and as movable blade finger 50 travels on its respective track 20, movable blade 34 moves relative to fixed blade 32. That is, movable blade 34 moves into and out of contact with fixed blade 32. As described above, such movement causes the associated electric circuit to be made and broken, which in turn results in the associated component coupled to blade assembly 28 being energized and deenergized.

Switch lift lever 30 includes a lever blade 56 and a finger 58 extending from lever blade 56. Lever blade 56 extends between fixed blade 32 and movable blade 34 of each contact blade assembly 28.

Figure 3:
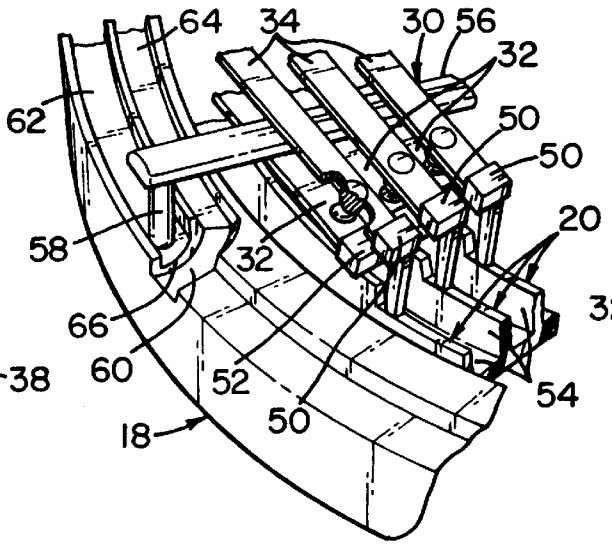
FIG. 3 is a perspective view of a portion the sequence switch unit shown in FIG. 1.

FIG. 3 is a perspective view of a portion sequence switch unit 10. As shown in FIG. 3, a ramp 60 connects a lower control track 62 and an upper control track 64. Lever blade finger 58 is oriented to travel within lower and upper control tracks 62 and 64. At an end 66 of lower control track 62, ramp 60 is located at an elevation below lower track 62 and extends upward to upper control track 64. Lever blade 56 is cammed to disk 18 so that when lever blade 56 drops onto ramp 60 from lower control track 62, lever blade 56 travels upward on ramp 60 and to upper control track 64.

Prior to operation, each contact blade assembly 28 is electrically connected to one of the dishwasher components, e.g., the drain solenoid, water valve, or heating element. In operation, and as switch disk 18 rotates (e.g., counter clockwise) relative to blade unit 26, the position of each movable blade 34 relative to its respective fixed blade 32 is controlled by the elevation of track 20 on which each respective blade assembly 28 travels. The track elevations are selected to correspond to the timing sequence desired for each respective component.

Figure 4:
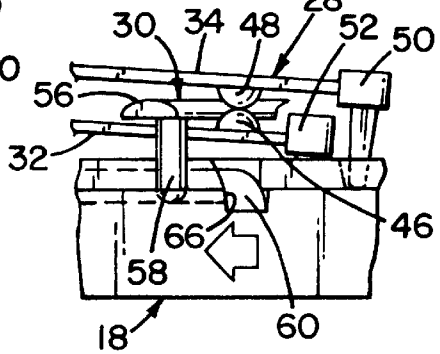
FIG. 4 is a side view of the portion of the sequence switch shown in FIG. 3 with the switch lift lever in a first position.

More particularly, and referring to FIG. 4 which is a side view of sequence switch 10, switch lift lever 30 is initially located in a first position as disk 18 rotates through the wash portion of the cycle. Specifically, at the beginning of the cycle and substantially throughout the cycle, lever blade finger 58 is in lower control track 62, and lever blade 56 is in a neutral position. In the neutral position, lever blade 56 does not affect a state of contact blade assemblies 28.

Figure 5:
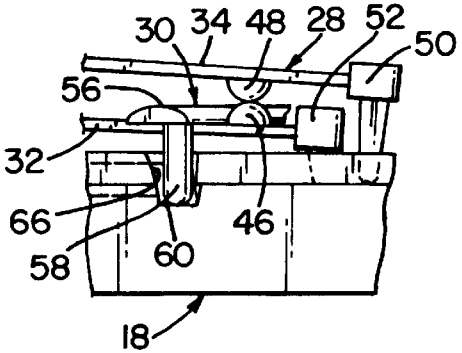
FIG. 5 is a side view of the portion of the sequence switch shown in FIG. 3 with the switch lift lever in a second position.

As shown in FIG. 5, at an end of a wash cycle, switch lift lever 30 is located in a second position in which lever blade finger 58 drops on ramp 60. In the second position, however, lever blade 56 still does not affect the i;state of each respective contact blade assembly 28. However, when disk 18 is rotated in a clockwise direction to return to its initial state, lever blade 56 then causes each contact blade assembly 28 to be in an open condition.

Figure 6:
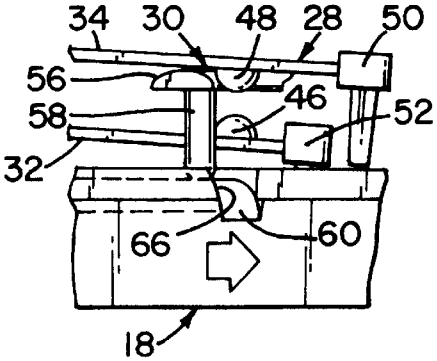
FIG. 6 is a side view of the portion of the sequence switch shown in FIG. 3 with the switch lift lever in a third position.

More particularly, and referring to FIG. 6, as disk 18 begins to rotate clockwise to return to its initial position, lever finger 58 rides up ramp 60 to upper control track 64. When lever blade finger 58 is in upper control track 64, lever blade 56 causes each of movable blades 34 to move away from its respective fixed blade 32 so that each contact blade assembly 28 is in the open position. Switch disk 18 is then rotated back (e.g., clockwise) to its initial position for the beginning of the cycle, and lever blade finger 58 drops into lower track 62 once disk 18 is fully rotated to its initial position. A ramp similar to ramp 60 can be provided to cause finger 58 to return to lower track 62. The cycle can then be repeated.

By opening contact blade assemblies 28 when returning to the start of the cycle, the components coupled to each contact blade assembly 28 are simply deenergized at the end of the cycle until the wash cycle is repeated. If contact blade assemblies 28 were not maintained open when rotating disk 18 back to its initial condition, the various components would be energized and deenergized as disk 18 is rotated back to its initial position. Of course, energizing and deenergizing the various components when returning to the start of the wash cycle would be highly undesirable.

Sequence switch unit 10 enables the elimination of separate timers and relays for at least some dishwasher components. Therefore, the component cost and assembly time associated with fabrication of known dishwashers is believed to be reduced. In addition, by eliminating such separate components, the maintenance and repair costs associated with known dishwashers also are believed to be reduced.

From the preceding description of the present invention, it is evident that the objects of the invention are attained. Although the invention has been described and illustrated in detail, it is to be clearly understood that the same is intended by way of illustration and example only and is not be taken by way of limitation. Accordingly, the spirit and scope of the invention are to be limited only by the terms of the appended claims.

What is claimed is:

1. A sequence switch unit for a dishwasher, said sequence switch unit comprising:

a switch disk comprising a plurality of contact blade tracks;

a blade unit comprising a plurality of contact blade assemblies, said switch disk rotatable relative to said blade unit, each of said contact blade assemblies comprising an elongate fixed blade having a fixed contact and an elongate movable blade having a movable contact, each of said contact blade assemblies normally in a closed condition in which said movable contact is in electric circuit with said fixed contact; and a switch lift lever secured to and rotatable with said switch disk, said switch lever extending between said fixed blade and said movable blade of each said contact blade assembly.

2. A sequence switch unit in accordance with claim 1 wherein said switch lift lever comprises a lever blade and a finger extending from said lever blade, said lever blade extending between said fixed blade and said movable blade of each said contact blade assembly, and said switch disk further comprises a lower track and an upper track, a ramp connecting said lower track and said upper track, and said lever blade finger being oriented to travel within said lower and upper tracks.

3. A sequence switch unit in accordance with claim 2 wherein when said lever blade finger is in said lower track, said lever blade is in a neutral position and does not affect a state of said contact blade assemblies.

4. A sequence switch unit in accordance with claim 2 wherein when said lever blade finger is in said upper track, said lever blade causes each of said movable blades to move away from each of said fixed blades.

5. A sequence switch unit in accordance with claim 2 wherein when said lever blade finger is in said upper track, each of said contact blade assemblies is in an open condition.

6. A sequence switch unit in accordance with claim 2 wherein said ramp extends from said lower track at an elevation below said lower track to said upper track so that when said level blade finger reaches said ramp, said level blade finger drops onto said ramp.

7. A sequence switch unit in accordance with claim 1 further comprising a drive gear coupled to said switch disk, and a motor coupled to said drive gear so that when said motor causes said drive gear to rotate, said switch disk rotates with said drive gear.

8. A sequence switch unit for a dishwasher, said sequence switch unit comprising:

a switch disk comprising a plurality of contact blade tracks, a lower control track, an upper control track, and a ramp connecting said lower control track and said upper control track;

a blade unit comprising a plurality of contact blade assemblies, said switch disk rotatable relative to said blade unit, each of said contact blade assemblies comprising an elongate fixed blade having a fixed contact and an elongate movable blade having a movable contact, each of said contact blade assemblies normally in a closed condition in which said movable contact is in electric circuit with said fixed contact;

a switch lift lever secured to and rotatable with said switch disk, said switch lever extending between said fixed blade and said movable blade of each said contact blade assembly, said switch lift lever comprising a lever blade and a finger extending from said lever blade, said lever blade extending between said fixed blade and said movable blade of each said contact blade assembly, said lever blade finger oriented to travel within said lower and upper tracks;

a drive gear coupled to said switch disk; and a motor coupled to said drive gear so that when said motor causes said drive gear to rotate, said switch disk rotates with said drive gear.

9. A sequence switch unit in accordance with claim 8 wherein when said lever blade finger is in said lower track, said lever blade is in a neutral position and does not affect a state of said contact blade assemblies.

10. A sequence switch unit in accordance with claim 8 wherein when said lever blade finger is in said upper track, said lever blade causes each of said movable blades to move away from each of said fixed blades.

11. A sequence switch unit in accordance with claim 8 wherein when said lever blade finger is in said upper track, each of said contact blade assemblies is in an open condition.

12. A sequence switch unit in accordance with claim 8 wherein said ramp extends from said lower track at an elevation below said lower track to said upper track so that when said level blade finger reaches said ramp, said level blade finger drops onto said ramp.

13. A sequence switch unit for a dishwasher, said sequence switch unit comprising a switch disk and a switch lift lever secured to and rotatable with said switch disk, said switch unit further comprising a blade unit comprising a plurality of blade assemblies, said blade assemblies comprising fixed blades having fixed contacts and movable blades having movable contacts, said blade assemblies arranged relative to said switch disk and said switch lift lever so that when said disk rotates in a first direction, said lever does not affect a state of said blade assemblies, and when said disk rotates in a second direction after rotation in said first direction to a predetermined location, said switch lift lever positions said movable blades in an open condition in which said movable contacts are not in electric circuit with said fixed contacts.

14. A sequence switch unit in accordance with claim 13 wherein said switch disk extends between said fixed blade and said movable blade of each said contact blade assembly.

15. A sequence switch unit in accordance with claim 13 wherein said switch lift lever comprises a lever blade and a finger extending from said lever blade, said lever blade extending between said fixed blade and said movable blade of each said contact blade assembly, said switch disk further comprising a lower track and an upper track, a ramp connecting said lower track and said second upper track.

16. A sequence switch unit in accordance with claim 15 wherein said predetermined location is said ramp.

17. A sequence switch unit in accordance with claim 15 wherein when said switch disk rotates in said first direction, said lever blade finger is in said lower track.

18. A sequence switch unit in accordance with claim 15 wherein when said switch disk rotates in said second direction, said lever blade finger is in said upper track.

19. A sequence switch unit in accordance with claim 15 wherein said ramp extends from said lower track at an elevation below said lower track to said upper track so that when said lever blade finger reaches said ramp, said lever blade finger drops onto said ramp.

20. A sequence switch unit in accordance with claim 15 further comprising a drive gear coupled to said switch disk, and a motor coupled to said drive gear so that when said motor causes said drive gear to rotate, said switch disk rotates with said drive gear.

* * * * *